US007488131B1

(12) United States Patent
Brower et al.

(10) Patent No.: US 7,488,131 B1
(45) **Date of Patent: *Feb. 10, 2009**

(54) PEN RETENTION APPARATUS

(75) Inventors: David C. Brower, Wake Forest, NC (US); Selcuk S. Eren, Chapel Hill, NC (US); Robert J. Heider, Durham, NC (US); Dean F. Herring, Youngsville, NC (US); Leo P. Richard, Raleigh, NC (US); Craig W. Turner, Raleigh, NC (US); Philip M. Woodward, Cary, NC (US)

(73) Assignee: International Business Machines Corporation, Armonk, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/146,197

(22) Filed: Jun. 25, 2008

Related U.S. Application Data

(63) Continuation of application No. 11/876,011, filed on Oct. 22, 2007.

(51) Int. Cl.
*B43K 23/02* (2006.01)

(52) U.S. Cl. ..... 401/131; 401/195

(58) Field of Classification Search ..... 401/48, 401/52, 131, 195; 242/375
See application file for complete search history.

(56) References Cited

U.S. PATENT DOCUMENTS 245,257 A 8/1881 Wright
1,874,813 A 8/1932 Saunders
2,419,215 A 4/1947 Hoppman
5,358,348 A 10/1994 Kennedy
6,065,892 A * 5/2000 Smith ..... 401/209
7,150,575 B1 12/2006 Minehart

FOREIGN PATENT DOCUMENTS

GB 2288150 A2 11/1995

* cited by examiner

*Primary Examiner*—Huyen Le
(74) *Attorney, Agent, or Firm*—Cantor Colburn LLP; Jason Piche

(57) ABSTRACT

A pen retention device including a pen, a tether, a retracting reel in operable communication with the tether, and a bracket releasably securing the retracting reel therein is disclosed. The pen retention bracket includes four surfaces that define a rectangular cavity having four sides and a top and bottom opening. A first protrusion and a second protrusion are disposed upon a first surface and extend from the first surface toward a second surface, a distance between the first protrusion and the second protrusion greater than a height of the pen tether retracting reel. The first surface is responsive to an application of force to the pen tether retracting reel to elastically deform and increase a depth between the second surface and at least one of the first protrusion and the second protrusion, thereby releasing the pen tether retracting reel via either of the top opening and the bottom opening.

2 Claims, 2 Drawing Sheets

PEN RETENTION APPARATUS

CROSS REFERENCE TO RELATED APPLICATION

This application is a Continuation application of U.S. Ser. No. 11/876,011, filed Oct. 22, 2007, the contents of which are incorporated by reference herein in their entirety.

BACKGROUND OF THE INVENTION

1. Field of the Invention

This invention relates generally to pen retention devices, and particularly to of point of sale signature pen retention devices.

2. Description of Background

Point of sale devices may provide pens, such as electronic signature pens for example, for a shopper to authorize a sale transaction. It is important to retain and secure the pen in a location that is convenient for use and such that it cannot easily be taken by the shopper. Typical pen retention arrangements include a tether attached to the pen and a retracting reel, such that the tether is drawn into the retracting reel when the pen is not in use. The pen is intended to be disposed within an accompanying recess such that the pen does not obstruct a flow of purchased products. To discourage any pilferage of the pen, tether, and retracting reel, the retracting reel is often disposed beneath a surface of the point of sale device, such that it is inaccessible to the shopper.

Disposal of the retracting reel beneath the surface of the point of sale device may result in application of force to the pen, via the tether, in a direction that increases a difficulty of use of the pen. Further, failure by the shopper to ensure proper return of the pen to the accompanying recess may result in the pen becoming entangled with the flow of purchased products and lead to tether failure. Repair of such tether failure requires a service technician to disassemble the point of sale device and replace the retracting reel, tether, and pen. Accordingly, there is a need in the art for a pen retention arrangement that overcomes these drawbacks.

SUMMARY OF THE INVENTION

An embodiment of the invention includes a pen retention bracket for releasably securing a pen tether retracting reel therein. The bracket includes a first and second surface disposed parallel and opposite one another and a third and fourth surface disposed parallel and opposite one another. The first, second, third, and fourth surfaces define a rectangular cavity having four sides including the first, second, third and fourth surfaces. The rectangular cavity includes a top opening and bottom opening disposed parallel and opposite one another.

A first protrusion and a second protrusion are disposed upon the first surface, and extend from the first surface toward the second surface. A distance between the first protrusion and the second protrusion is greater than a height of the pen tether retracting reel. A depth between the first surface and the second surface is approximately equal to a depth of the pen tether retracting reel and a depth between the second surface and both of the first protrusion and the second protrusion is less than the depth of the pen tether retracting reel. The first surface is responsive to an application of force to the pen tether retracting reel to elastically deform and increase the depth between the second surface and at least one of the first protrusion and the second protrusion, thereby releasing the pen tether retracting reel via either of the top opening and the bottom opening.

Another embodiment of the invention includes a pen retention device that includes a pen, a tether having a first end and a second end, the first end of the tether attached to the pen, a retracting reel in operable communication with the second end of the tether, and a bracket releasably securing the retracting reel therein. The bracket includes a first and second surface disposed parallel and opposite one another and a third and fourth surface disposed parallel and opposite one another. The first, second, third, and fourth surfaces define a cavity having four sides including the first, second, third and fourth surfaces. The cavity includes a top opening and bottom opening disposed parallel and opposite one another.

A first protrusion and a second protrusion are disposed upon the first surface, and extend from the first surface toward the second surface. A distance between the first protrusion and the second protrusion is greater than a height of the pen tether retracting reel. A depth between the first surface and the second surface is approximately equal to a depth of the pen tether retracting reel and a depth between the second surface and both of the first protrusion and the second protrusion is less than the depth of the pen tether retracting reel. The first surface is responsive to an application of force to the pen tether retracting reel to elastically deform and increase the depth between the second surface and at least one of the first protrusion and the second protrusion, thereby releasing the retracting reel via either of the top opening and the bottom opening.

Additional features and advantages are realized through the techniques of the present invention. Other embodiments and aspects of the invention are described in detail herein and are considered a part of the claimed invention. For a better understanding of the invention with advantages and features, refer to the description and to the drawings.

BRIEF DESCRIPTION OF THE DRAWINGS

The subject matter which is regarded as the invention is particularly pointed out and distinctly claimed in the claims at the conclusion of the specification. The foregoing and other objects, features, and advantages of the invention are apparent from the following detailed description taken in conjunction with the accompanying drawings in which:

The detailed description explains the preferred embodiments of the invention, together with advantages and features, by way of example with reference to the drawings.

DETAILED DESCRIPTION OF THE INVENTION

An embodiment of the invention provides a pen retention bracket to retain and secure the retracting reel, tether, and pen. The pen retention bracket further allows replacement of the retracting reel, tether, and pen by a retailer without need for a service technician to disassemble the point of sale device.

Figure 1:
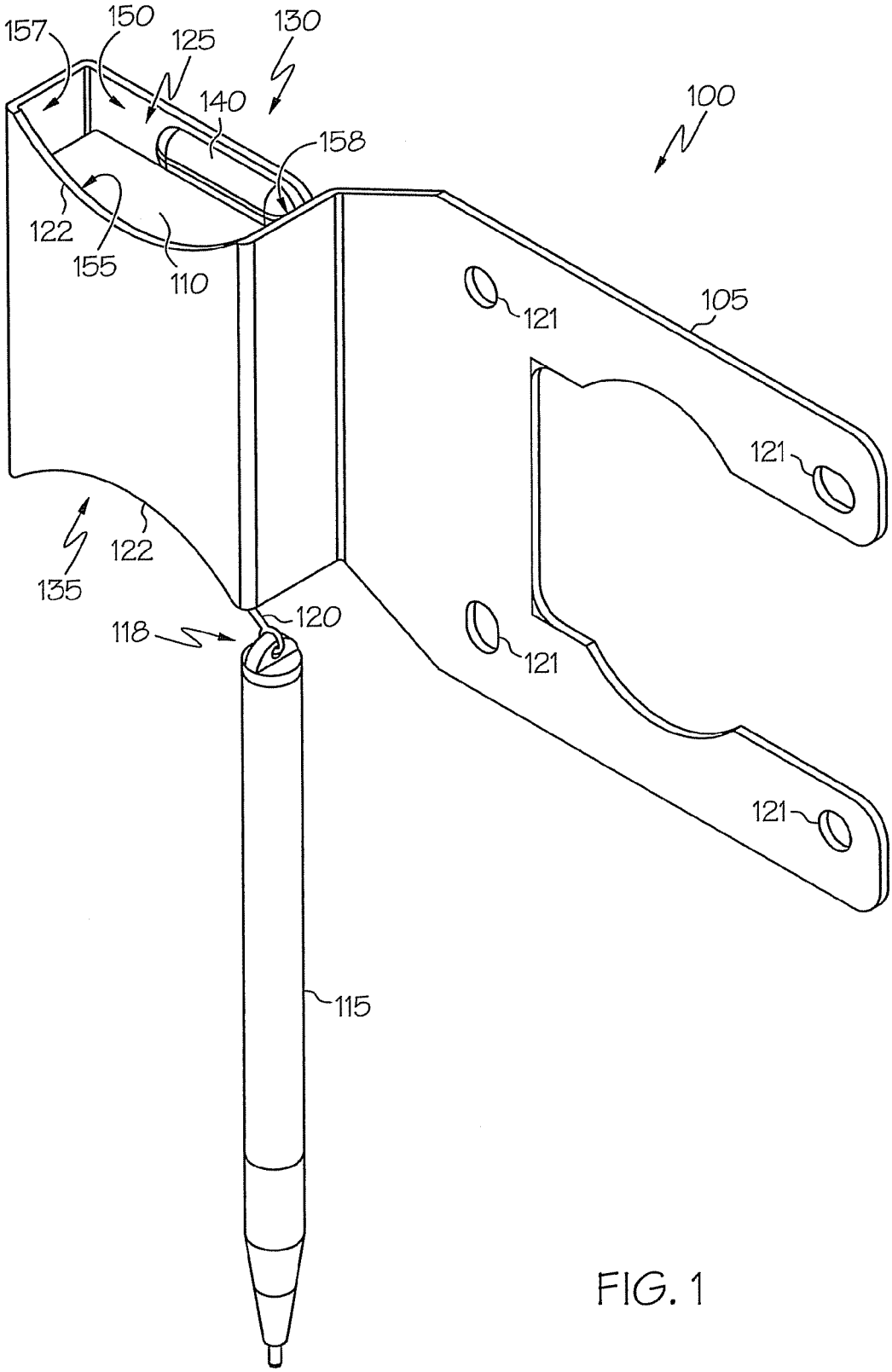
FIG. 1 is a front perspective view of a pen retention device in accordance with an embodiment of the invention.
Figure 2:
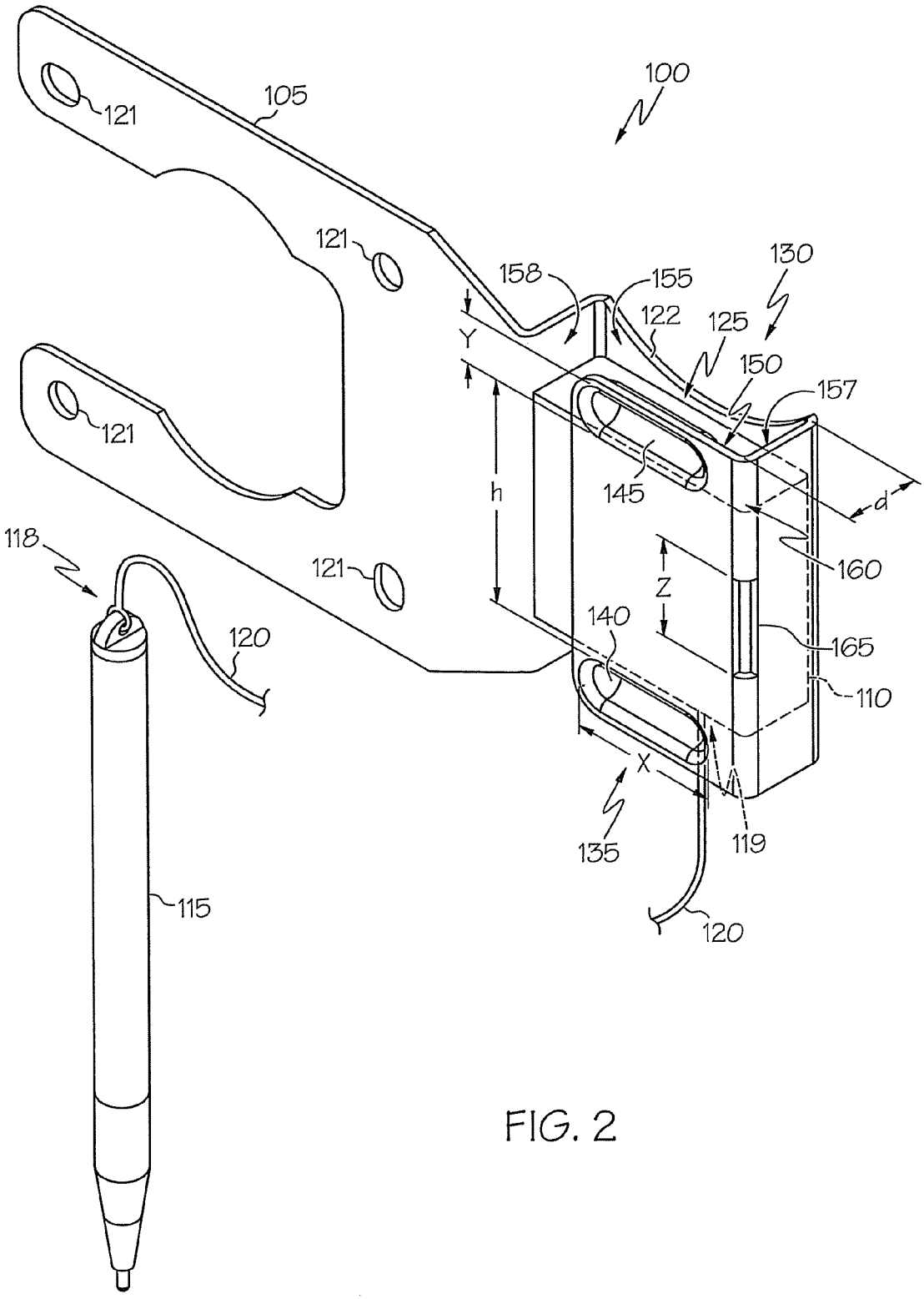
FIG. 2 is a rear perspective view of the pen retention device of FIG. 1 in accordance with an embodiment of the invention.

FIGS. 1 and 2 depict an embodiment of a pen retention device 100. The pen retention device 100 includes a bracket 105, a retracting reel 110 (also herein referred to as a "pen tether retracting reel"), a pen 115, and a tether 120, such as a string or wire for example. The tether includes a first end 118 attached to the pen 115 and a second end 119 in operable communication with the retracting reel 110. The tether 120 is withdrawn from the retracting reel 110 to allow the shopper to utilize the pen 115 to authorize a sales transaction. The retracting reel 110 includes a retraction mechanism such as a spring to retract or return the tether 120 within the retracting reel 110 when the pen 115 in not in use.

The bracket 105 includes mounting features 121, such as holes, for mounting to a point of sale device (not shown). In an exemplary embodiment, the bracket 105 is installed vertically above an area in which the pen 115 shall be used, such that any force exerted upon the pen 115 by the retracting reel 110 shall be directed upwards to prevent an increase in difficulty of use of the pen 115 by a downwardly directed force. Further, an embodiment of the bracket 105 includes a recess 122, to reduce interference between the bracket 105 and the tether 120, thereby reducing a likelihood of fraying of the tether 120.

The bracket 105 surrounds the retracting reel 110, thereby defining a cavity 125 to retain the retracting reel 110. The cavity 125 has a top opening 130 and a bottom opening 135 disposed opposite the top opening 130. The retracting reel 110 may be inserted into the cavity 125 via either of the top opening 130 and the bottom opening 135.

A first surface 150 of the bracket 105 is disposed parallel and opposite to a second surface 155. A third surface 157 is disposed parallel and opposite to a fourth surface 158. Accordingly, in one embodiment, the first surface 150, second surface 155, third surface 157, and fourth surface 158 define the cavity 125 to be a rectangular cavity 125 having four sides that include the first, second, third, and fourth surfaces 150, 155, 157, 158 and the top opening 120 and bottom opening 135.

A distance or depth "d" of the cavity 125 from the first surface 150 to the second surface 155 is approximately equal to a depth of the retracting reel 110. As used herein "approximately" represents deviation resulting from design, manufacturing, and material tolerances, as well as a desired interface between the retracting reel 110 the cavity 125, such as a slip fit assembly, for example.

Two protrusions 140, 145 (also herein referred to as a "first protrusion" and a "second protrusion") are disposed upon the first surface 150 of the bracket, and extend from the first surface 150 into the cavity 125 toward the second surface 155, such that the depth from the protrusions 140, 145 to the second surface 155 is less than the depth of the retracting reel 110. A height "h" between the protrusions 140, 145 is equal to or greater than a height of the retracting reel 110. Accordingly, the protrusions 140, 145 restrict or interfere with, movement toward either the top opening 130 or the bottom opening 135 of the retracting reel 110 disposed between the protrusions 140, 145 within the cavity 125. The protrusions 140, 145 are each defined by a height "y" and a width "x". In one embodiment, the width "x" is greater than the height "y", such that the protrusions 140, 145 are rectangular protrusions 140, 145.

The material of the bracket 105 deforms in an elastic manner, such that surface 150 may be displaced away from surface 155 to increase the depth "d" of the cavity 125. In response to such displacement of surface 150 away from surface 155, the depth from the protrusions 140, 145 to surface 155 is increased. Further, in response to displacement of surface 150 such that the depth from the protrusions 140, 145 to surface 155 is equal to or greater than the depth of the retracting reel 110, the retracting reel 110 may be inserted into the cavity 125 for disposal between the protrusions 140, 145 via either of the top opening 130 or the bottom opening 135. Likewise, in response to displacement of surface 150 such that the depth from the protrusions 140, 145 is equal to or greater than the depth of the retracting reel 110, the retracting reel 110 disposed within the cavity 125 between the protrusions 140, 145 may be removed from the cavity 125 via either of the top opening 130 or the bottom opening 135.

A material from which the bracket 105 is fabricated and a thickness of the material influences an amount of force required to displace surface 150 such that the depth from the protrusions 140, 145 to surface 155 is equal to or greater than the depth of the retracting reel 110. Accordingly, selection of at least one of the material and the thickness of the material from which the bracket 105 is made effects an amount of force applied to the retracting reel 110 via at least one of the pen 115 and the tether 120 to remove or release the retracting reel 110 from the cavity 125. As such, the bracket 105 provides a "break-away" feature that releases the retracting reel 110 in response to application of the amount of force that exceeds a release force. Furthermore, removal of material from a corner 160 of the bracket 105 disposed between the first surface 150 and the third surface 157 defines an opening 165, such as a rectangular aperture 165. An amount of material removed from the corner 160, and thus the size of the rectangular aperture 165 is inversely related to the amount of release force required to remove the retracting reel 110 from the cavity 125. That is, the more material removed, the larger the opening 165, and the less the release force required to remove the retracting reel 110 from the cavity 125 of the bracket 105. Accordingly, selection of the material, material thickness and opening 165 dimensions determine the release force. Stated alternatively, the first surface 150 is responsive to an application of force to the retracting reel 110 to elastically deform away from the second surface 155 and thereby release the pen tether retracting reel 110 via one of the top opening 130 and the bottom opening 135.

In one embodiment, the release force is selected to release the retracting reel 110 prior to damage to (or failure of) either the tether 120 or the retracting reel 110. Therefore, following such release of the retracting reel 110, useful functionality of the retracting reel 110, pen 115, and tether 120 is preserved. For example, following an inadvertent entanglement of the pen 115 with a purchased product (not shown) the bracket 105 releases the retracting reel 110 prior to exertion of a force great enough to damage either the tether 120 or the retracting reel 110. Such release of the retracting reel 110 prior to exertion of a force great enough to damage either the tether 120 or retracting reel 110 is contemplated to reduce a likelihood of shopper injury and allow subsequent reinstallation of the released retracting reel 110. Furthermore, interaction between the retracting reel 110 and the bracket 105 may be apparent to the shopper, who may proceed to disentangle the pen 120 and replace the retracting reel 110 within the cavity 125 of the bracket 105. In any event, installation of a replacement retracting reel 110, whether it be the released reel 110 or a new reel 110, is easily accomplished with a need for neither disassembly of the point of sale device (not shown) nor a technician service repair call.

In one embodiment, the bracket 105 is made from steel having a thickness of approximately 1.5 millimeters (mm), with the opening 165 having a height "z" of approximately 20 mm.

While the preferred embodiment to the invention has been described, it will be understood that those skilled in the art, both now and in the future, may make various improvements and enhancements which fall within the scope of the claims which follow. These claims should be construed to maintain the proper protection for the invention first described.

What is claimed is:

1. A method for retaining a pen, the method comprising:

providing a pen;

attaching the pen to a first end of a tether;

communicating a second end of the tether with a retracting reel;

releasably securing the retracting reel within a bracket, the bracket comprising:

a first surface and a second surface, the second surface disposed parallel to and opposite the first surface;

a third surface and a fourth surface, the fourth surface disposed parallel to and opposite the third surface, thereby defining a cavity having four sides comprising the first surface, the second surface, the third surface, and the fourth surface, the cavity having a top opening and a bottom opening, the top opening disposed opposite the bottom opening;

a first rectangular protrusion and a second rectangular protrusion disposed upon the first surface, the first rectangular protrusion and the second rectangular protrusion extending from the first surface toward the second surface, a distance between the first rectangular protrusion and the second rectangular protrusion greater than a height of the retracting reel;

wherein a depth between the first surface and the second surface is approximately equal to a depth of the retracting reel;

wherein the retracting reel is disposed within the cavity between the first rectangular protrusion and the second rectangular protrusion;

wherein a depth between the second surface and both of the first rectangular protrusion and the second rectangular protrusion is less than the depth of the retracting reel;

wherein the first surface is responsive to an application of force to the retracting reel to elastically deform and increase the depth between the second surface and at least one of the first rectangular protrusion and the second rectangular protrusion, thereby releasing the retracting reel via either of the top opening and the bottom opening.

2. The method of claim 1, wherein the cavity is a rectangular cavity.

* * * * *